United States Patent [19]

Rennie

[11] Patent Number: 5,061,102

[45] Date of Patent: Oct. 29, 1991

[54] APPLICATOR MEANS FOR PREPARATION, AND A METHOD OF FORMING SAME

[76] Inventor: Patrick Rennie, 34 Wood Rd., Morristown, N.J. 07960

[21] Appl. No.: 508,185

[22] Filed: Apr. 12, 1991

[51] Int. Cl.[5] ..... B43K 23/00; B43K 23/02

[52] U.S. Cl. ..... 401/98; 401/88; 401/131; 206/820; 248/909

[58] Field of Search ..... 401/88, 98, 131; 206/820, 345, 346, 443, 634; 248/513, 520, 174, 909

[56] References Cited

U.S. PATENT DOCUMENTS

| | | | |
|---|---|---|---|
| 2,171,486 | 8/1939 | Van Fleet | 401/2 |
| 4,442,938 | 4/1984 | Murphy | 206/443 |
| 4,838,851 | 6/1989 | Shabo | 132/320 X |

FOREIGN PATENT DOCUMENTS

| | | | |
|---|---|---|---|
| 315937 | 5/1989 | European Pat. Off. | 401/98 |

*Primary Examiner*—Danton D. DeMille

*Attorney, Agent, or Firm*—Bernard J. Murphy

[57] ABSTRACT

The Applicator Means comprises a plurality of identical applicators joined to a freestanding base by frangible couplings. Each applicator is configured to receive a sample of substance or preparation, i.e., lipstick, or such, by deposition on a stub end thereof. A removable cap is set over the stub end of each applicator to shield such substance or preparation as will be deposited on the stub end. The base, couplings and applicators constitute a single, unitized molding. The Method defines the steps to be exercised in depositing a preparation (i.e., the product sample of lipstick, or the like) on the stub ends of the applicators, simultaneously.

11 Claims, 1 Drawing Sheet

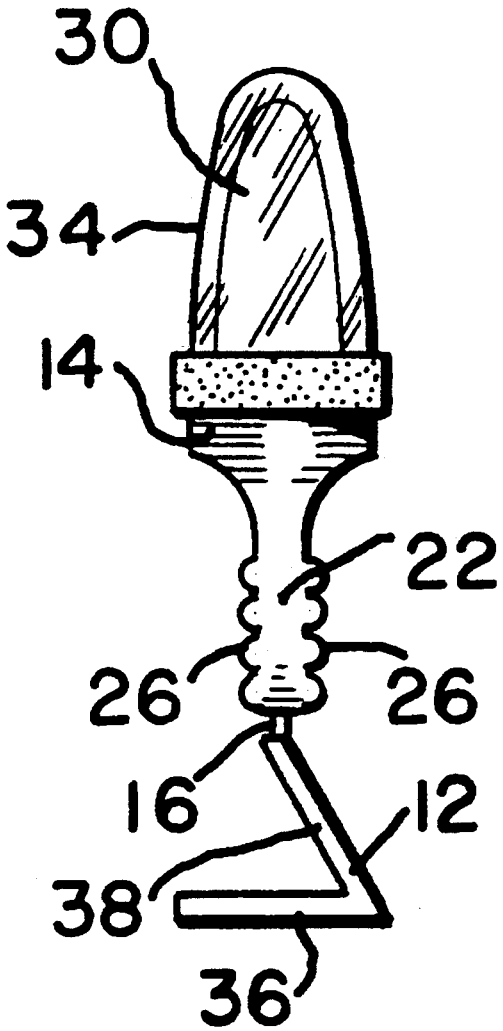

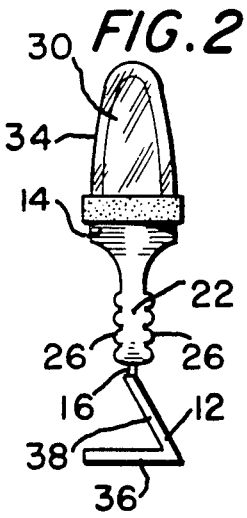

FIG. 2

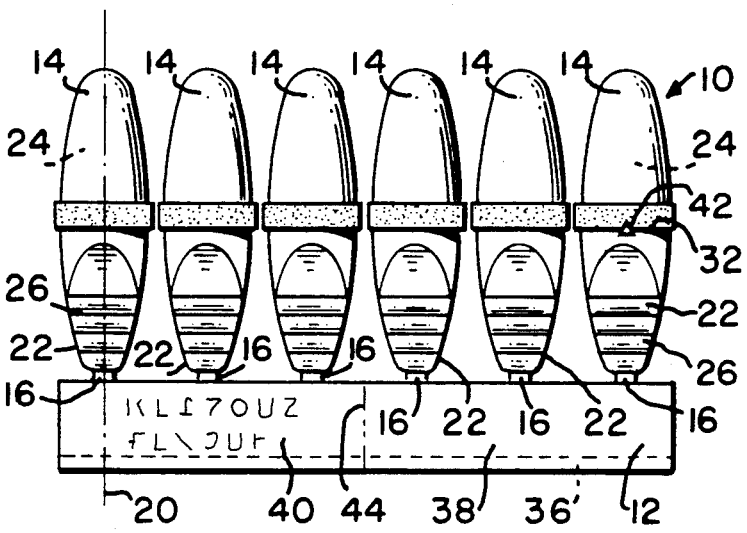

FIG. 1

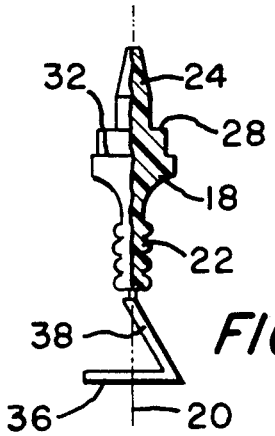

FIG. 3

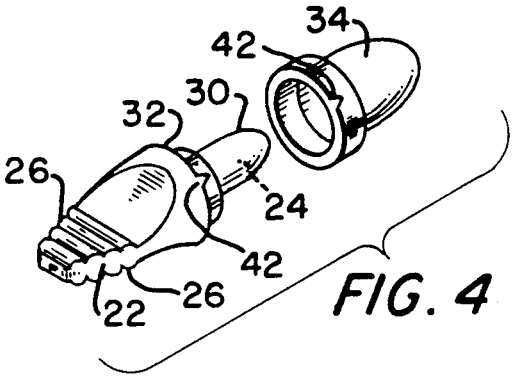

FIG. 4

INTEGRALLY FORMING (a) A BASE WITH AN ANGULAR CROSS-SECTION, (b) A PLURALITY OF APPLICATORS, EACH WITH A STUB AT A TERMINAL END THEREOF, AND (c) MEANS, COUPLING SAID PLURALITY TO SAID BASE, WHICH HAS READILY FRANGIBLE CHARACTERISTICS;

PROVIDING A RESERVOIR OF PREPARATION FOR DEPOSITION ON SAID STUBS; AND

DEPOSITING SUCH PREPARATION ON SAID STUBS BY DIPPING SAID STUBS INTO SAID PREPARATION IN SAID RESERVOIR.

FIG. 5

APPLICATOR MEANS FOR PREPARATION, AND A METHOD OF FORMING SAME

This invention pertains to dispensers and applicators for substances or preparations, such as lipstick, eye shadow, lip balm, and the like, and in particular to a novel applicator means for preparations, such as the aforesaid, and to a novel method of forming the same.

Various techniques are used for the sampling of cosmetics, for example, in commercial and retail establishments. Thus, typically, a lipstick is maintained at a display counter, and individuals may sample the same by applying the lip wax directly to the lips, or on the back of a hand. This, of course, is conducive to the transfer of bacteria and other germs. Other articles used in this known manner are pencils and brushes for dispensing eye shadow, eye liner, powder, and such. This traditional practice continues yet.

Some retailers, to obviate germ transfer, have offered cottom swabs, cotton balls, single-use palettes,and tissue wipes for cleaning lipstick. Now, while these define a more hygienic environment for the sampling of a product, they require maintaining a constanct supply of the chosen accessories, and monitoring to insure that they are not depleted, causing self-defeating reuse of once used materials.

What has been long sought, then, is an applicator means providing single use for product sampling, and such applicator means which, following the single use, may be discarded. The same would militate against germ transfer. It is well known, in the prior art, how to prepare eye liners, lipsticks, and the like, and to obviate the hygienic problem cited, it is only necessary to manufacture and provide applicator means which have only enough preparation or substance for a single, sampling use. However, such is cost prohibitive. Forming applicators, and charging them with a sample content of substance or preparation, is expensive. Accordingly, in addition to the need for product-sampling, single use applicator means, there is a correlative need for a method of forming an applicator means of the aforesaid type. It is an object of this invention, then, to meet the just recited needs by setting forth an applicator means for preparations, which offers product-sampling, single use, as well as to disclose a method of forming such an applicator which, further, has a sample quantity of substance of preparation carried thereon.

Particularly, it is an object of this invention to set forth an applicator means for preparations, such as cosmetics, lip balms, and the like, comprising a base; a plurality of applicators; and means coupling said plurality to said base, integrally.

Also, it is an object of this invention to set forth a method of forming applicator means having thereon an preparation, such as a cosmetic, lip balm, or the like, comprising the steps of integrally forming (a) a base, (b) a plurality of applicators, and (c) means coupling said plurality to said base; and depositing a preparation on said applicators of said plurality thereof.

Further objects of this invention, as well as the novel features and procedural steps thereof, will become more apparent by reference to the following description taken in conjunction with the accompanying figures, in which:

FIG. 1 is a front, elevational view of an applicator means according to an embodiment of the invention;

FIG. 2 is a side elevational view, the same taken from the left-hand end of FIG. 1;

FIG. 3 is a side elevational view of an applicator, base and coupling in which the applicator is shown partly cross-sectioned;

FIG. 4 is an exploded view of an applicator and cap; and

FIG. 5 is a block diagram setting forth the novel steps of the inventive method.

As shown in the figures, the novel applicator means 10 has a base 12 and a pluralit of applicators 14 integrally joined to the base 12. Each of the applicators 14 is joined to the base 12 by a frangible coupling 16. The applicators 14 are identical, and each has a body 18 with a longitudinal axis 20, a finger grip 22 at one end, and stub 24 at the other, opposite, axial end.

The base 12, bodies 18 and couplings 16 are integerally formed of a plastic material selected to meet overall product (i.e, substance or preparation) requirements, e.g., product compatibility and low cost. The material selected, however, must have characteristics conducive to ease of removal at the break points presented as couplings 16. One family of suitable materials is the styrenics; thermoplastics which are available in degrees of brittleness and suitable for forming into the applicator means 10.

To facilitate handling, the finger grips 22 have ribbing 26 formed thereon. The bodies 18 each have a first, external land 28 which circumscribes the stub 24. Together, the stud 24 and the land 28 define means for receiving and supporting a substance or preparation 30 thereon. Further, each body 18 has a second, external land 32 which serves as a receptor and stop for a closure cap 34. The caps 34 are hollow, and are open at only one end thereof; the latter is what seats against the land 32 to enclose and shield the stub 24 (and preparation 30).

The base 12, in cross-section, defines an acute angle. It has a elongate, flat foot 36 which defines a bearing surface for horizontal disposition thereof, whereby the novel applicator means 10 can be supported for free-standing, upright, vertical display, and a limb 38; joining the foot 36 to the couplings 16. The limb 38, for being angled, is especially suitable for carrying thereon a manufacturer's or shop's advertising text or trade name and/or trade mark 40. The longitudinal axis 20 of the bodies 18, as shown in FIG. 3, bisects the foot 36, substantially midway across the foot, to locate the center of gravity thereat and, thereby, to insure that the applicator means 10 can effect a free-standing, upright, vertical display.

The closure caps 34 may be opaque, translucent, or transparent as shown in FIG. 2. Self-evidently, they may be colored as, if the preparation 30 is lipstick, a complement to the lipstick color. To insure that the substance or preparation 30 has not been tampered with, the caps 34 may be fused ot the bodies 18; to depict such a fusing or welding on one assembly of cap and body is index number 42. The same may be done by use of ultrasonics at a very localized spot in the front (or rear, for aesthetics) of each cap 24 and body 18 on the base 12. The person who grasps an applicator 14, and breaks it off of the base 12 at the frangible coupling 16 for sampling of the preparation 30, will encounter no significant difficultu, beyond a slight resistance, in separating the weld 42 and removing the cap 34 from the body 18.

As can be appreciated, the applicator means 10 comprises a unitized molding of the base 12, applicators 14 and frangible couplings 16. Similarly, the caps 34 lend themselves to a unitized molding; in this, a cluster thereof would be formed with fine connectors (not unlike the couplings 16). This additional feature and practice would provide additional evidence that the applicator means 10, if the connectors are all secure, has not been tampered with.

To practice the cost-effective method of the invention, one would provide a resevoir of the selected substance or preparation 30 and, holding the applicator means 10 by the base 12, dip the axial stubs 24 into the reservoir to the depth defined by the land 28. Such dipping may require one or more repeats to effect an accreation of preparation 30, thereon, in the amount desired.

As illustrated in FIG. 1, six bodies 18 are joined to the base 12. Clearly, the number of bodies may be as great as the relevant molding machinery is capable of forming. Then, the base 12 may have a frangible line 44 whereat the base may be subdivided. Depending upon the length of the applicator means 10 as it comes from the molding operation, and the number of applicators 14 which it is desired to have in a single display, there may be several frangile lines 44 formed in the base 12.

In a preferred embodiment, the caps 34 are formed of a styrene-acrylonitrile (SAN) plastic, due to its low cost, transparency, colorability, ease of molding, and compatibility with lip-gloss products. However, other plastics of suitable characteristics are readily available. The shape of the applicators 14, somewhat simulating a lipstick, is not material. Too, the rather dog-leg angulation of the base 12 is optional as well; other cross-sectional shapes, which nonetheless offer a free-standing support for upwright, vertical display of the applicator means 10, will be just as acceptable. The ribbing 26 shown is not critical; other grip surfaces, which take the form of other discontinuities in the surface of the grip 22, may be used. Optionally, the grip 22 may be devoid of such discontinuities, as shown in FIG. 3, if the economics of the molding process warrants.

Here then is disclosed an applicator means 10 which lends itself to economical, mass production formation, and the method offers a simple and expedient manner of providing product-sampling, single use deposition of a substance or preparation on a great multiple of applicators 14 with a sole reservoir. The burden of forming individual, separate applicators, and charging them each with sample, is clearly obviated. Too, the consumer/user is assured that the applicator 14 taken from the base 12 has not been used by others, and may be discarded after sampling the product/prepatation 30. While I have described my invention in connection with a specific embodiment thereof, and a given method of forming the same, it is to be clearly understood that this is done only by way of example, and not as a limitation to the scope of the invention, as set forth in the objects thereof and in the appended claims.

I claim:

1. Applicator means for preparations, such as cosmetics, lip balms, and the like, comprising:

a base;

a plurality of applicators; and means coupling said applicators to said base, integrally, wherein said means comprise means for facilitating separation of said applicators, of said plurality thereof, from said base;

said separation facilitating means comprises frangile couplings between said base and each of said applicators of said plurality;

said base has a flat foot which comprises means for supporting said applicator means for free-standing, upright, vertical display, and a limb extending from said foot to said frangible couplings for joining said couplings and said plurality of applicators to said foot;

each applicator, of said plurality thereof, has a body;

each said body has a longitudinal axis which bisects said foot substantially midway across said foot, to render said applicator means vertically free-standing, as aforesaid; and each said body has a finger grip at one axial end thereof, and a stub at the opposite, axial end.

2. Applicator means, according to claim 1, wherein:

each said body further has an external land circumscribing said stub; and said stub and said land, together, define means for receiving and supporting a preparation thereon.

3. Applicator means, according to claim 1, wherein:

each said body further has a first, external land circumscribing said stub;

said stub and said first land, together, define means for receiving and supporting a preparation thereon; and each said body also has a second, external land intermediate the length thereof; and further including a hollow closure cap which is open at only one end thereof; and wherein said second land defines a receptor and stop upon which said open end of said cap is removably emplaced.

4. Applicator means, according to claim 3, wherein:

each said body has a given, outer circumference, intermediate said first and second lands; and sai cap has a like, given circumference therewithin; whereby said cap effects an interference fit, with said body, in enveloping closure of said stub.

5. Applicator means, according to claim 1, wherein:

said grip has surface discontinuities formed thereon to render handling thereof facile.

6. Applicator means, according to claim 3, wherein:

said cap is transparent.

7. A method of forming applicator means having thereon a preparation, such as a cosmetic, lip balm, or the like, comprising the steps of:

integrally forming (a) a base, (b) a plurality of applicators, and (c) means coupling said plurality to said base; and depositing a preparation on said applicators of said plurality thereof.

8. A method, according to claim 7, wherein:

said forming step further comprises forming said coupling means with readily frangible characteristics.

9. A method, according to claim 7, wherein:

said forming step further comprises forming each of said applicators, of said plurality thereof, with a stub at a terminal end thereof; and said depositing step comprises depositing such preparation on said stubs of said applicators.

10. A method, according to claim 9, wherein:

said depositing step further comprises providing a reservoir of such preparation, and dipping said stubs into sid preparation in said reservoir.

11. A method, according to claim 7, wherein:

said forming step further comprises forming said base with means for facilitating a subdivision thereof.

* * * * *